US011305843B2

(12) United States Patent
Hovde et al.

(10) Patent No.: US 11,305,843 B2
(45) Date of Patent: Apr. 19, 2022

(54) SYSTEM FOR QUICK RELEASE OF MOORING AND LOADING AND UNLOADING LINES BETWEEN A LOADING AND UNLOADING STATION AT SEA AND A VESSEL

(71) Applicant: APL Norway AS, Kolbjornsvik (NO)

(72) Inventors: Geir O Hovde, His (NO); Anders L Eide, Arendal (NO)

(73) Assignee: APL Norway AS, Kolbjørnsvik (NO)

( * ) Notice: Subject to any disclaimer, the term of this patent is extended or adjusted under 35 U.S.C. 154(b) by 0 days.

(21) Appl. No.: 17/258,254

(22) PCT Filed: Jul. 2, 2019

(86) PCT No.: PCT/NO2019/000022

§ 371 (c)(1),
(2) Date: Jan. 6, 2021

(87) PCT Pub. No.: WO2020/013700

PCT Pub. Date: Jan. 16, 2020

(65) Prior Publication Data

US 2021/0284287 A1 Sep. 16, 2021

(30) Foreign Application Priority Data

Jul. 10, 2018 (NO) ..... 20180971

(51) Int. Cl.
*B63B 21/16* (2006.01)
*B63B 27/08* (2006.01)
(Continued)

(52) U.S. Cl.
CPC ..... *B63B 21/16* (2013.01); *B63B 27/08* (2013.01); *B63B 27/18* (2013.01); *B63B 2021/002* (2013.01); *B63B 2021/004* (2013.01)

(58) Field of Classification Search
CPC ..... B63B 21/00; B63B 2021/001; B63B 2021/002; B63B 2021/003; B63B 21/04;
(Continued)

(56) References Cited

U.S. PATENT DOCUMENTS 3,442,245 A 5/1969 Christians et al.
3,541,622 A * 11/1970 Harlow ..... B63B 22/021 441/5

(Continued)

FOREIGN PATENT DOCUMENTS

EP 2385011 B1 11/2011
WO WO 03/059728 A1 7/2003

OTHER PUBLICATIONS

International Search Report in International Application No. PCT/NO2019/000022, dated Oct. 9, 2019.

*Primary Examiner* — Daniel V Venne
(74) *Attorney, Agent, or Firm* — Leydig, Voit & Mayer, Ltd.

(57) ABSTRACT

A system for release of mooring loading and unloading lines between a loading and unloading station at sea and a vessel comprises a yoke with mooring tethers, for connection between the yoke and the vessel. A method for quick release comprises disconnecting the lines, connecting them to a winch arrangement; lowering line connectors for parking on a parking structure on the yoke if the swivel is above sea level, or on the sea floor if the swivel is close to the sea floor; lowering the yoke by the winch arrangement after the line connectors are parked on the parking structure if the swivel is above sea level, lowering the yoke with the line connectors if the swivel is close to the sea floor; stopping the winch arrangement when the yoke has landed on the sea floor, and further lowering the mooring tethers on the sea floor by moving the vessel.

14 Claims, 15 Drawing Sheets

(51) Int. Cl.
*B63B 27/18* (2006.01)
*B63B 21/00* (2006.01)

(58) Field of Classification Search
CPC ... B63B 2021/004; B63B 21/16; B63B 21/20; B63B 27/00; B63B 27/08; B63B 27/18; B63B 27/19; B63B 27/30
USPC ... 114/230.1, 230.2, 230.23, 230.25, 230.26, 114/230.29
See application file for complete search history.

(56) References Cited

U.S. PATENT DOCUMENTS

| | | | | |
|---|---|---|---|---|
| 3,674,062 | A | 7/1972 | Ellers et al. | |
| 6,227,135 | B1 | 5/2001 | Pedersen | |
| 7,543,543 | B2 * | 6/2009 | Boatman | B63B 21/50 114/230.1 |
| 2004/0094082 | A1 | 5/2004 | Boatman et al. | |
| 2005/0106959 | A1 | 5/2005 | Storvoll et al. | |
| 2011/0139054 | A1 | 6/2011 | Liu et al. | |
| 2014/0283727 | A1 | 9/2014 | Liu et al. | |
| 2016/0114861 | A1 | 4/2016 | Janik | |
| 2017/0113762 | A1 | 4/2017 | Lindblade | |

* cited by examiner

SYSTEM FOR QUICK RELEASE OF MOORING AND LOADING AND UNLOADING LINES BETWEEN A LOADING AND UNLOADING STATION AT SEA AND A VESSEL

CROSS-REFERENCE TO RELATED APPLICATIONS

This patent application is the U.S. National Stage of International Patent Application No. PCT/NO2019/000022, filed Jul. 2, 2019, which claims the benefit of Norwegian Patent Application No. 20180971, filed Jul. 10, 2018, which are each incorporated by reference.

TECHNICAL FIELD

The present invention relates to an arrangement for mooring, loading and unloading a floating vessel, in which the arrangement comprises a rigid yoke, which at one end is connected via a three-degree of freedom rotational joint to a structure attached to the sea floor, and at the other end to the floating vessel via two mooring tethers, and where the end of the tethers towards the floating vessel are releasably attached to the vessel, allowing the vessel to disconnect from the tethers and thus the yoke in the event of weather conditions exceeding the design limits or for any other reasons that require a disconnection from the arrangement. The invention also describes a method for releasing the loading and unloading lines that transfer fluid (such as hydrocarbons in form of oil and gas) between the structure attached to the sea floor and the floating vessel.

BACKGROUND

For mooring, loading and unloading a floating vessel in shallow waters, such as a Floating Production, Offloading and Storage (FPSO) vessel, Floating Storage and Regasification Unit (FSRU), Floating Liquified Natural Gas (FLNG) vessel, etc., one possible mooring and fluid transfer arrangement is to use a submerged turret yoke system. This system or arrangement comprises a structure attached to the sea floor. A rigid yoke is further attached to this structure by a turret that makes it possible for the yoke to rotate around the vertical axis of the said structure. The yoke is further fitted with rotational means, located close to the turret, allowing the yoke to also rotate around the two other rotational axes. At the other end the yoke is attached to mooring tethers, which are further connected to the floating vessel. The tethers are hinged at both ends and have limited or full freedom to rotate around its own axis. The position restoring forces of the vessel from the yoke system is then obtained by adding permanent ballast to the yoke at a distance from the turret table that typically coincides with the connection points for the tethers. The total weight of the yoke, including the required amount of ballast, can be significant, and especially if the arrangement shall moor the vessel in extreme weather conditions.

The fluid transfer from the structure on the sea floor and the floating vessel is typically via a fluid swivel on the said structure, hard pipes, flexible lines and required valve arrangement. The fluid swivel can be located either subsea or above sea level. The rotational axis of the fluid swivel is the same as for the turret Designing a mooring arrangement in shallow water can in areas with very extreme weather conditions prove difficult.

An arrangement which can be disconnected from the floating vessel in the event of forecasted abnormally high sea states may thus be required.

A releasable arrangement may also be required for applications where the floating vessel is applied for shuttling of fluid, i.e. the vessel will frequently connect and disconnect from the arrangement.

To obtain high operability of the arrangement the sea states for which the disconnection can take place should be as high as possible. This means that during the disconnect operation the vessel may have large motions, which must to be considered for the design of a releasable arrangement.

Related prior art is disclosed in GB2014928A, U.S. Pat. Nos. 4,530,302, 6,227,135B1, 6,439,147B2, NO316266B1, U.S. Pat. Nos. 6,932,015B2, 8,763,549B2, 9,573,659B2 and WO2017/074813A1, wherein U.S. Pat. Nos. 8,763,549B2, 9,573,659B2 and WO2017/074813A1 relate to other, but different, solutions for yoke mooring arrangements with disconnection feature.

The present invention provides a solution for disconnection a submerged yoke arrangement with fluid swivel either subsea or above sea level. The disconnection is done at the vessel side for both the fluid lines and the mooring tethers.

SHORT SUMMARY OF THE INVENTION

The invention describes a system for quick release of mooring, loading and unloading lines between a loading and unloading station at sea and a vessel comprising a rigid yoke connected to a lower part of the station and being rotable around a vertical axis going through the station, a horizontal axis perpendicular to the longitudinal direction of the yoke and an axis along the longitudinal direction of the yoke. The system further comprise at least two mooring tethers, for connection between the outer end of the yoke and the vessel; at least one loading or unloading line connected to a swivel on the station being rotable around the same vertical axis as the yoke and mooring cradles for connecting the mooring tethers to the bow or stern of the vessel. Furthermore the system comprise line connectors for connecting the loading, and unloading lines to the vessel and a winch arrangement located on the vessel near the line connectors and near the mooring cradle.

The system features a method for quick release of the mooring between the loading station and the vessel comprising the steps: disconnecting the loading and unloading lines, and connecting them directly or indirectly to a winch arrangement; lowering the line connectors to be parked on a parking structure on the yoke if the swivel is above sea level, or on the sea floor in a direction mainly parallel with the centerline of the yoke if the swivel is close to the sea floor and lowering the yoke by means of the winch arrangement after the line connectors is parked on the parking structure if the swivel is above sea level, and lowering the yoke simultaneous with the line connectors if the swivel is close to the sea floor. The method further comprise the steps of stopping the winch arrangement from pulling on the yoke when the yoke has landed on the sea floor, and further lowering the mooring tethers into parked position on the sea floor by moving the vessel astern. Furthermore the system comprise means to absorb impact energy at the bottom of the yoke.

BRIEF DESCRIPTION OF THE FIGURES

Below, various embodiments of the invention will be described with reference to the figures, in which like numerals in different figures describes the same features.

DETAILED DESCRIPTION OF PREFERRED EMBODIMENTS

Figure 1:
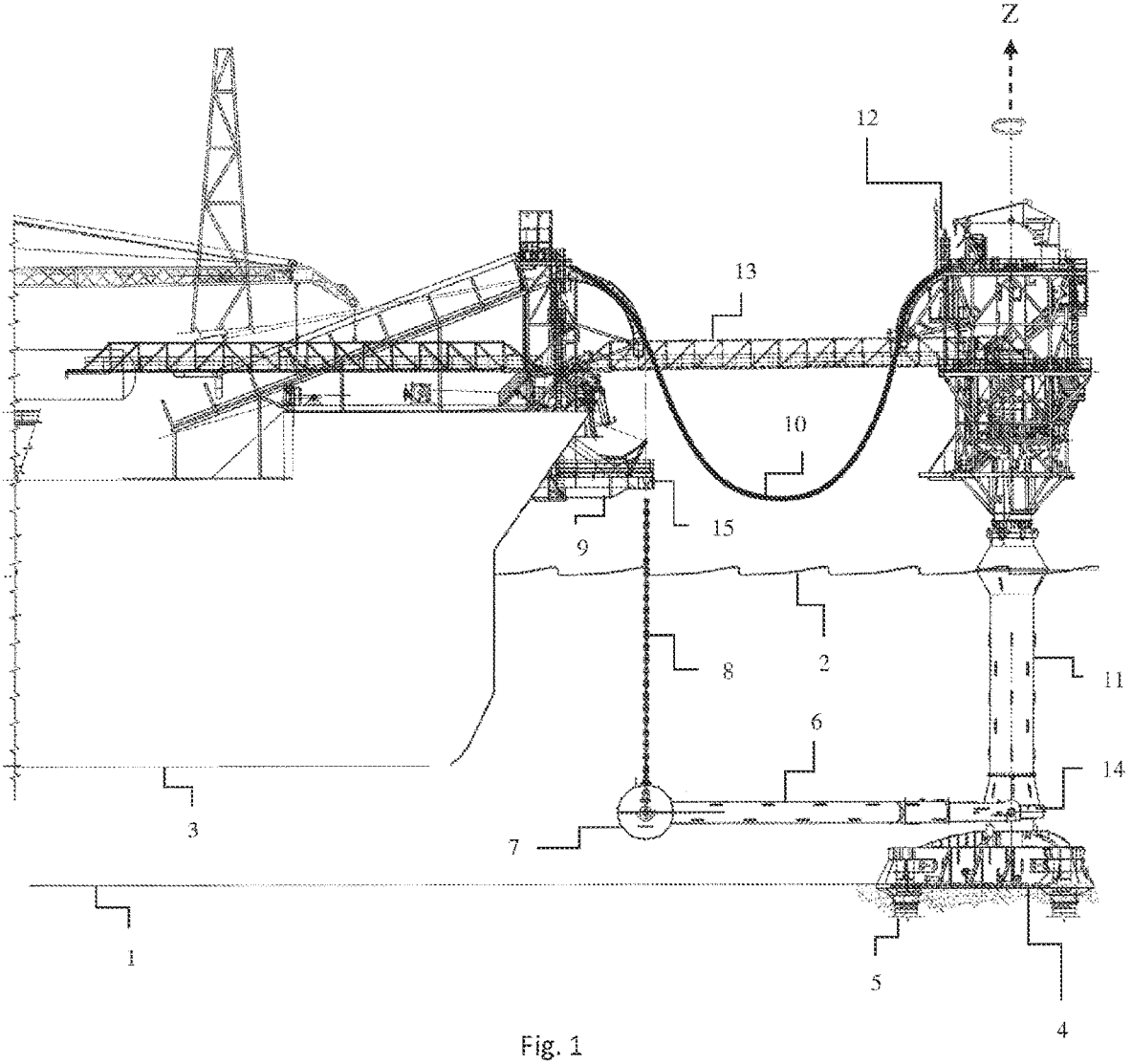
FIG. 1 shows a side view of typical general arrangement of a vessel connected to a submerged yoke system with fluid swivel above sea level.

This invention describes a system including a method for managing the disconnection and connection of a mooring yoke arrangement from a floating vessel 3, in which the mooring yoke arrangement is connected to the vessel via at least two mooring tethers 8 and at least one fluid line 10 (also denoted "jumper"). The system comprises several devices on the vessel such as winches 19, 21, mooring cradles 15, structural connectors 39 for jumper beam and connectors 41 for fluid, power and/or utility lines. On the part of the yoke system which is disconnected from the vessel the system comprises devices such as mooring tethers 8, which can mate with the mooring cradles 15, and may also comprise a jumper beam 20 with accessories that can mate with the connectors 39 and 41. In one embodiment the mooring yoke 6 is equipped with a parking structure 22, on which the jumper beam 20 can be parked when disconnected from the vessel. In another embodiment the jumpers 10 or the jumper beam 20 is placed directly on the sea floor 1.

One major difference from other disconnectable yoke systems is the combination of a submerged yoke, in which the yoke and the jumpers are disconnected at the vessel side and parked safely on the sea floor, and the control and operation of the winches 19, 21 to reduce the impact forces, when the yoke system is disconnected from the vessel in severe weather conditions.

To ease the explanation we use an orthogonal axes system wherein the z-axis coincides with the centerline of the tower 11, turret 14 and fluid swivel 12. The x-axis is in the length direction of the yoke 6, while the y-axis is in the beam direction of the yoke. The length axis of the yoke 6 is in the same vertical plane as the plane containing the vector defined by a line between the vessel 6 and the tower 11. Further, "disconnection" and "connection"/"re-connection" may be used interchangeable, where "connection"/"re-connection" means that the arrangement is picked up from the parked position on the sea floor 1, and "disconnection" means that the arrangement is lowered from the vessel 3 into parked position on the sea floor 1.

FIG. 1 gives an overall view of a permanent submerged yoke arrangement with the fluid swivel above sea surface 2. Herein "permanent" means that frequent disconnections and connections are not required. The system comprises a subsea structure 4, which is attached to the sea floor 1 by means 5, which can be driven piles, drilled and grouted piles, suction piles, weight element(s), etc. A tower structure 11 is attached on top of structure 4. This tower structure comprises an inner and outer part, where the inner part (geo-stationary part) is fixed to the structure 4, while the outer part is connected to the yoke 6 and can rotate around the inner part by the turret 14. At the top of the tower the fluid swivel and associated piping and valves are mounted, which is herein defined as the topside 12. The topside 12 is also divided into a geostationary part and a rotating part. The rotation of the rotating part is driven by the weather-vaning of the vessel 3 via the yoke 6 and the outer part of the tower 11. Fluid, power and utility lines 10, also called loading and unloading lines, are at one end connected to the rotating part of the topside 12 and to the vessel 3 at the other end. The yoke 6 has a heavy section 7, which provides the mooring restoring characteristics of the yoke system. The yoke 6 is further connected to the vessel via mooring tethers 8, which at the lower end is connected to the yoke close to the heavy section 7, and at the upper end is connected to a mooring cradle 15 mounted on a mooring arm 9 on the vessel 3. Further, an access bridge 13 between the vessel 3 and the topside 12 secures that personnel can access the topside from the vessel. This bridge can be disconnected at the topside and swung around a pedestal at the vessel into parked position on the vessel, when not in use or when the weather conditions gets rougher than the operational limits of the bridge. The bridge may be of a telescopic type to obtain a wide envelope of relative motions between vessel and topside.

Figure 2:
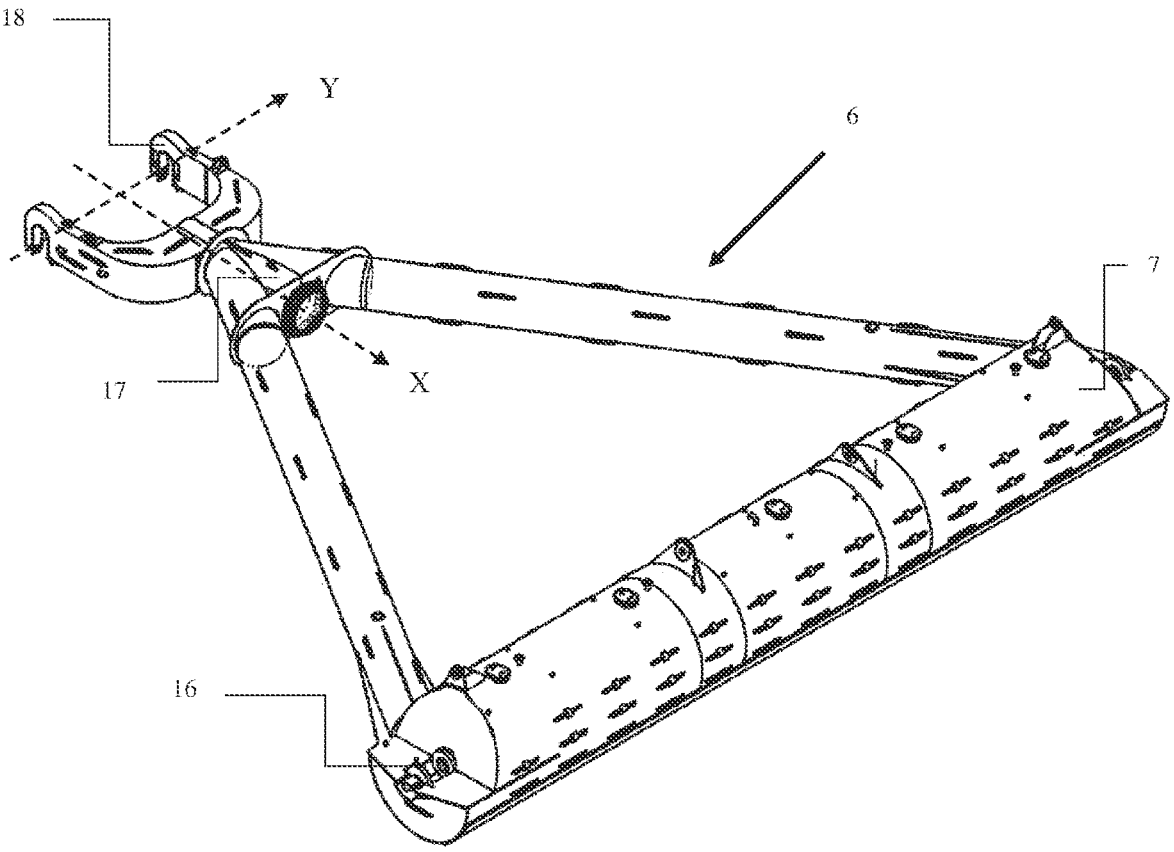
FIG. 2 shows a typical general arrangement of the mooring yoke.

FIG. 2 shows a typical mooring yoke 6. The yoke is at one end connected to the mooring tethers 8 via attachment means 16. The part 7 is typically a large tank, which can be filled with ballast to obtain the weight required for the targeted mooring restoring characteristics. The attachment means 16 and the heavy section 7 is typically, but not necessarily, located at the same length position (x) of the yoke. The other end provides a two degrees-of-freedom joint connection towards the turret 14. Rotation about the x-axis is obtained by means 17, while means 18 is a combined arrangement for fixation to the turret 14 and means for rotation about the y-axis.

Figure 3:
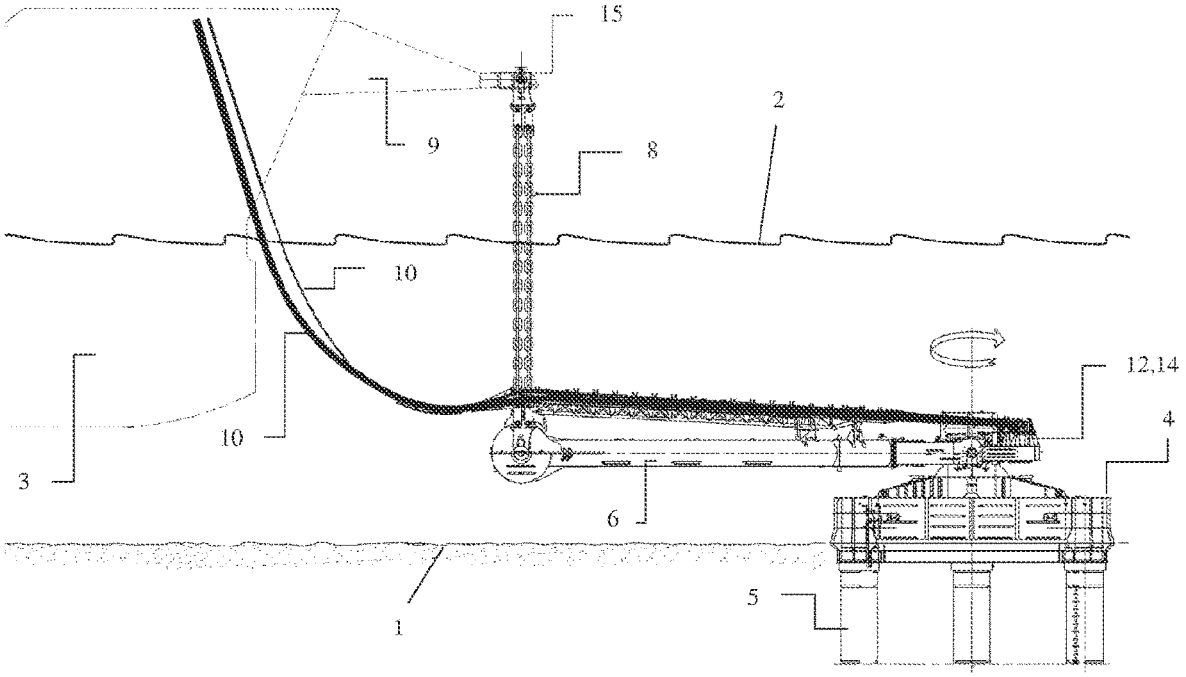
FIG. 3 shows a side view of a typical general arrangement of a vessel connected to a submerged yoke system with fluid swivel below sea level, i.e. subsea fluid swivel.

FIG. 3 gives an overall view of a permanent submerged yoke arrangement with the fluid swivel below sea surface 2. The arrangement is very similar to the arrangement shown in FIG. 1. The main difference is that the tower structure 11 and the access bridge 13 are not present, and the fluid swivel and associated piping and valves 12 are located subsea directly on top of the structure 4. This arrangement is typically applied when the number of jumpers are few. In one embodiment the lower section of the jumpers is placed in a gutter on the yoke 6, such as shown in FIG. 3. In another embodiment the jumpers are configured in a wave configuration obtained by means such as distributed buoyancy elements, weight elements, tether lines, etc. One such example is presented in FIGS. 13-15.

Figure 4:
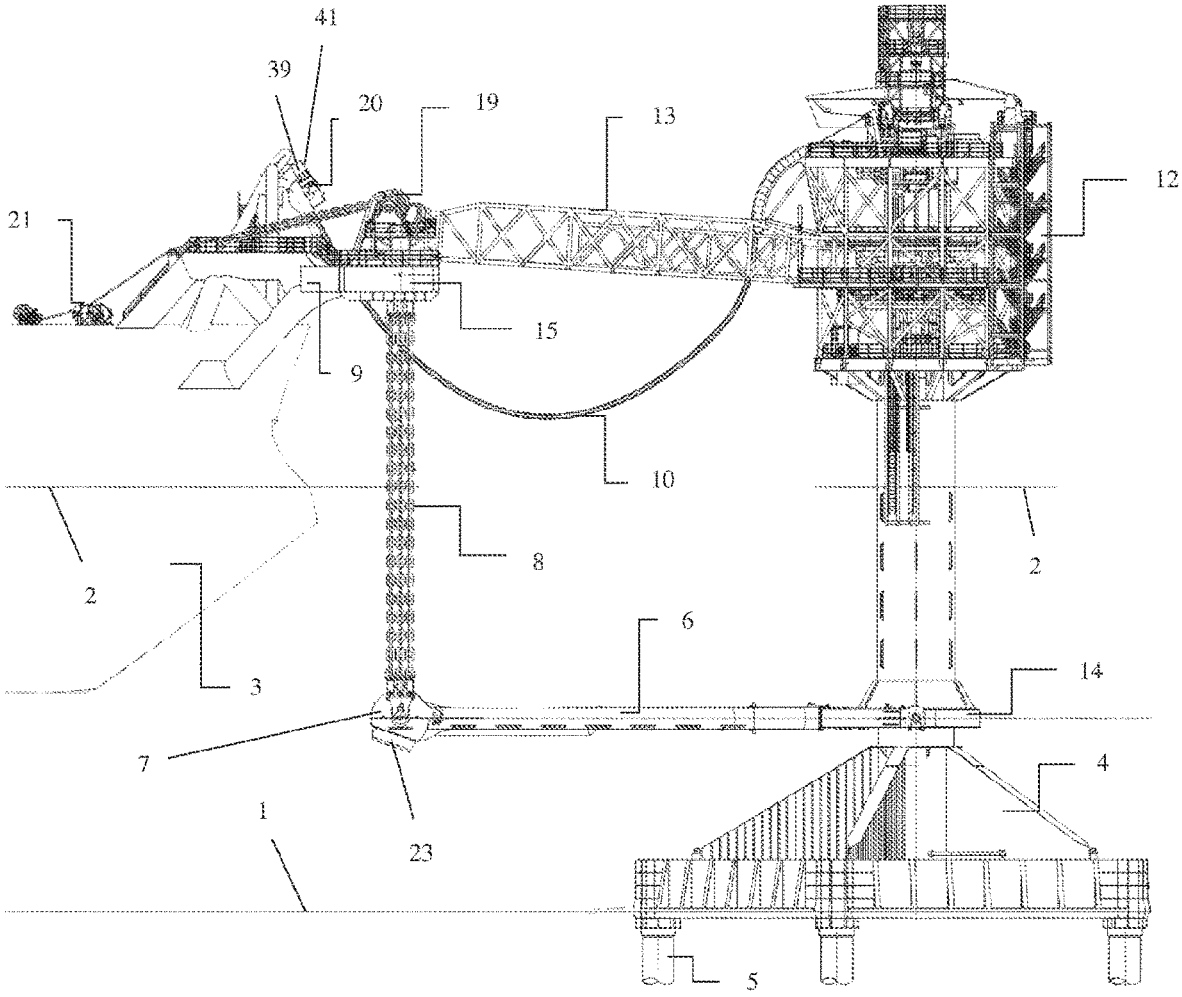
FIG. 4 shows a side view of a typical general arrangement of a vessel connected to a submerged yoke system with fluid swivel above sea level, and with equipment for frequent disconnections and connections.
Figure 5:
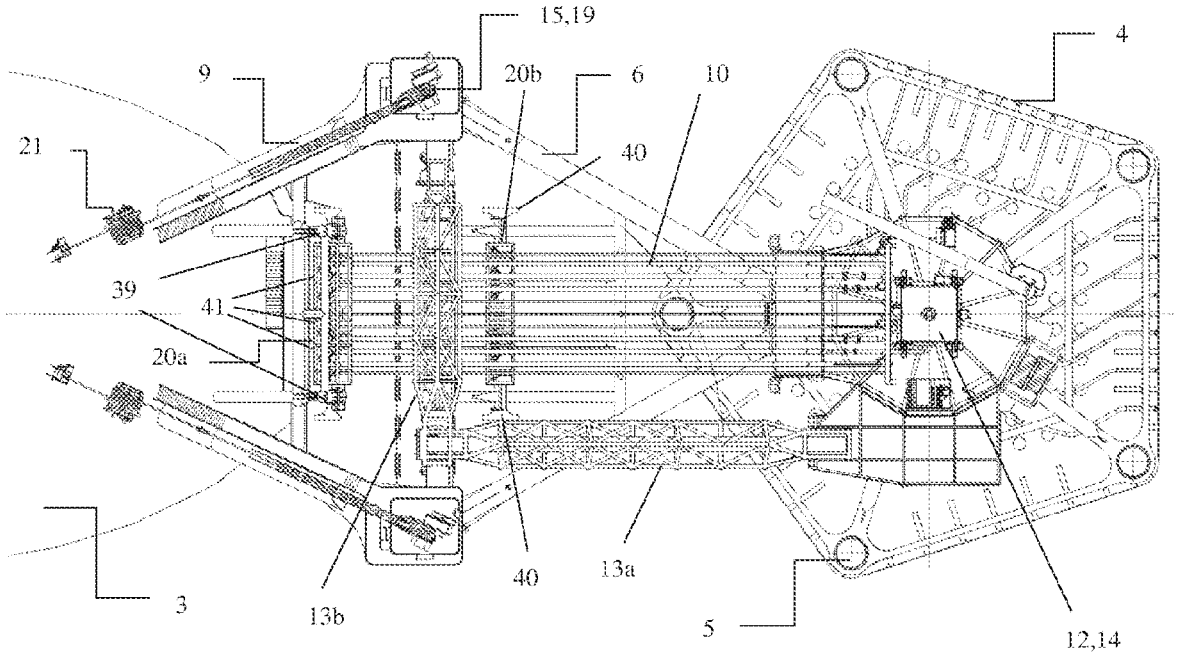
FIG. 5 shows a top view of a typical general arrangement of a vessel connected to a submerged yoke system with fluid swivel above sea level, and with equipment for frequent disconnections and connections.
Figure 6:
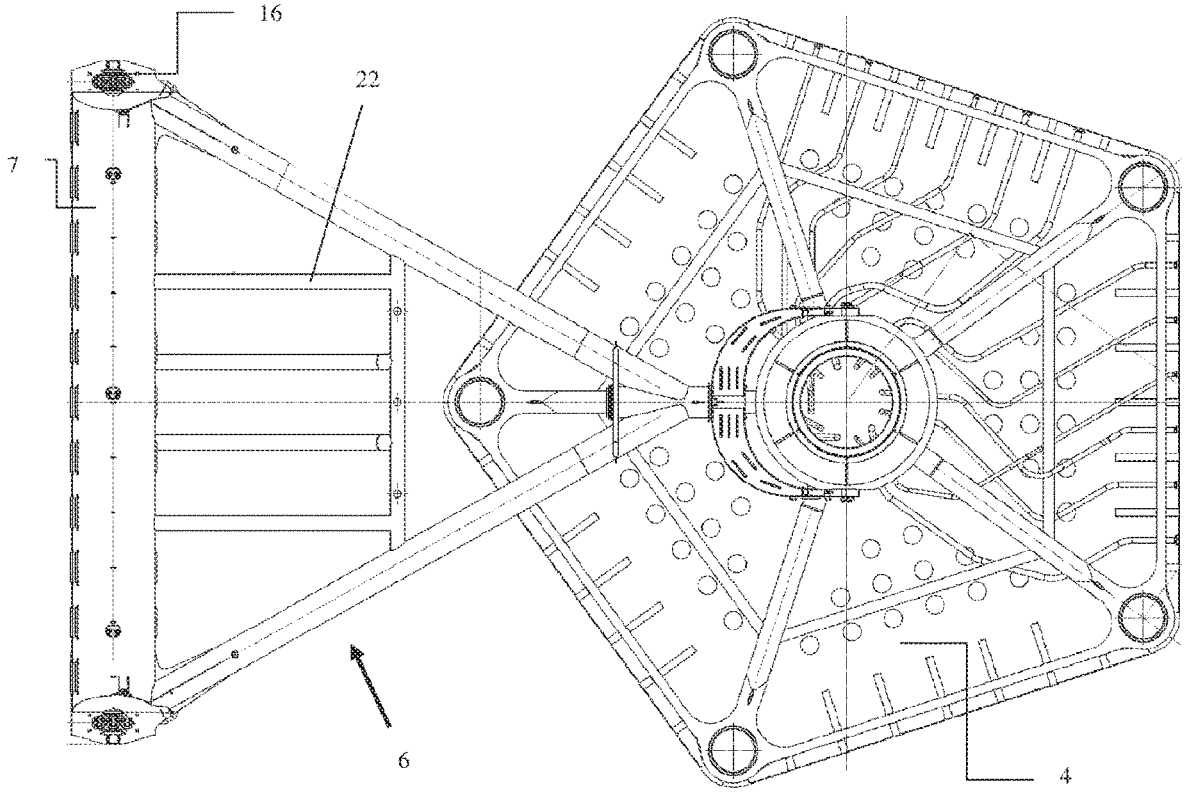
FIG. 6 shows a top view of the general arrangement of the mooring yoke when attached to the structure on sea floor.
Figure 11:
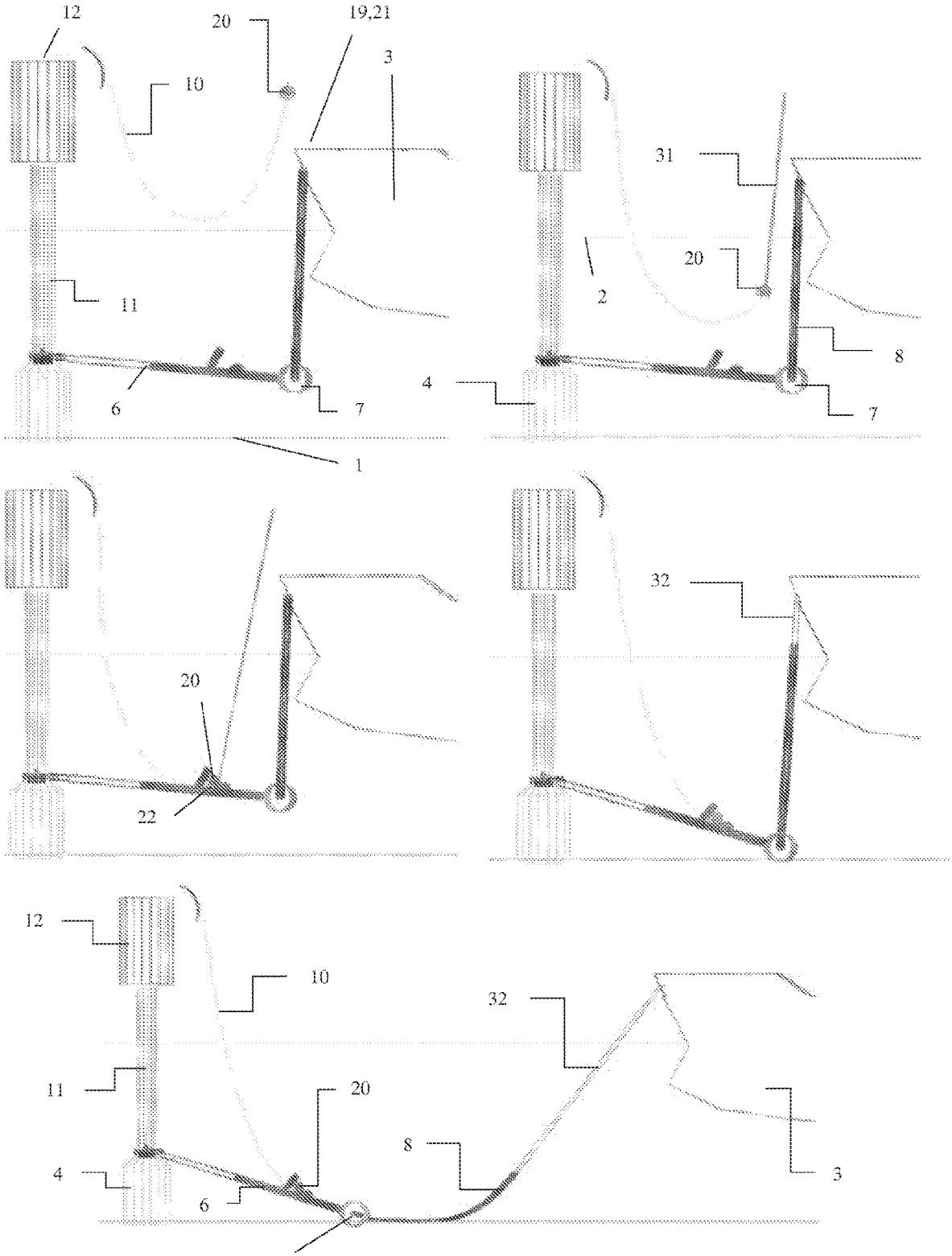
FIG. 11 shows a disconnect sequence for a submerged yoke system with fluid swivel above sea level.

FIGS. 4-6 give an overall view of a disconnectable submerged yoke arrangement with the fluid swivel above sea surface 2. The main added features compared to the permanent system shown in FIG. 1 relate to the winch arrangement 19, 21, jumper beam 20, structural connectors 39 for jumper beam, and means 22 for parking jumper beam 20 on yoke 6. The shown winch arrangement comprises two sets of two winches, i.e. one set for each mooring tether and each side of the jumper beam. The required winch arrangement depends strongly on the sea state during disconnection and connection, weight of yoke and number of jumpers. In another embodiment the winch arrangement may be reduced to one or two winches or even increased, but without affecting the principals of the invention. The following description is however based on an arrangement comprising two sets of two winches, where the two sets are operated in parallel. For disconnection the typical high level stepwise procedure will be: (1) Disconnect each jumper at the connectors 41. These connectors can either be quick-release connectors or manual connectors (such as flanged connections); (2) The winch lines from the two secondary winches 21 are routed via sheaves to each side of the jumper beam 20 via the structural connectors 39. The structural connectors are then released and the jumper beam with all the connected jumpers are lowered onto the yoke 6. Since the yoke 6 will follow the motion of the vessel 3 the relative motion between the jumper beam and the yoke will mainly be driven by the speed of the winch, which implies that the lowering and landing of the jumper beam 20 onto the interfacing structures 22 on the yoke 6 are done in a very controlled manner. Some relative motions may however still occur, and to secure a successful parking on the yoke the jumper beam 20 has a guide 40 on each side with opposing parking structure 22 on the yoke. When the jumper beam is parked on the yoke the guides 40 restrict the jumper beam from moving sideways (y-direction) on the yoke. The beam can however slide in the x-direction along the interfacing parking structure 22. The beam is kept in place on the yoke by its own weight, the guides 40 and the interfacing parking structure 22. If necessary the jumper beam can be firmly locked to the yoke, but in a typical application this is not considered necessary. When the jumper beam is safely parked, the winch lines are disconnected from the winches 21 and dropped into the sea for later pick-up (re-connection of the yoke system); (3) In a typical arrangement the primary winch 19 is a winch where the winch line is chain (such as a wildcat winch or a chain-jack), but can also be a drum or traction winch for rope. The chain part of the winch line is connected to the connecting link 24 of the mooring tether 8 (see FIG. 8) at one end. This pull chain is then routed via the primary winch 19 and connected at the other end to a rope which is further connected to the secondary winch 21. The two primary winches then pull on the mooring tethers such that the entire weight of the mooring tethers 8 and yoke 6 with jumper beam 20 are taken by the primary winches instead of the mooring cradles 15. The mooring cradles can then be moved aside such that the primary winches can lower the tethers past the cradles. The winches continue to lower until the yoke has landed on the sea floor 1; (4) When yoke has landed on the sea floor the vessel 3 starts to move astern; (5) During the operation with the primary winch 19 the secondary winch 21 pulls on the rope attached to the pull chain with a load in the same order as the weight of the mooring tether 8. When the pull chain is fully disengaged from the primary winch the secondary winch continues to pay out rope while the vessel is moving astern; (6) When the entire mooring tethers are placed on the sea floor the rope is disconnected from the winch and dropped into the sea for later pick-up (re-connection of the yoke system). FIG. 11 gives an illustration of the lay-down process. Re-connection will mainly follow the same steps, but in opposite order.

For marginal weather conditions during disconnection and reconnection no special features will be needed for safe landing of the yoke on the sea floor. However, to increase operability and uptime of the system it is essential to disconnect and connect, and especially disconnect, during normal and severe weather conditions. One objective for the invention is thus to limit the impact loads when the yoke 6 hits the sea floor. The impact load is driven by the velocity of the yoke relative the sea floor at the time of impact, and a high velocity gives larger impact loads compared to a low velocity. During disconnection the motion of the yoke is mainly driven by the heave (vertical) motion of the vessel at the hang-off of the mooring tethers 8 and the speed of the winch. The motion of the vessel is driven by the waves (weather condition), and modifying the vessel to reduce the motions of the vessel is not part of the invention.

One way to reduce the relative velocity between yoke and sea floor is to use a motion- or heave-compensated winch. For a heavy yoke 6 a typical motion-compensated winch may be unwanted due to its large size, complexity and cost. Such a winch typically also compensates for a two-way motion, such as up and down, which may not be required. One inventive step is thus to control the pay-out speed of the winch during disconnect such that when the hang-off point for the tethers on the vessel is moving upwards relative the sea floor the winch is paying out at a higher speed than when the they are moving downwards towards the sea floor. The winch will then not be a complete motion-compensated winch, because it will never pull in the winch line, but by reducing the pay-out speed (potentially to zero velocity) when the vessel is moving down then the impact load between yoke and sea floor will be reduced compared to a situation where the winch line is paid-out at a higher speed. The speed of the winch can for instance be adjusted by active use of a disc or drum brake, but can also be adjusted by other means, such as by actively running the electrical or hydraulic motors in winch.

For re-connection the winch will pull in the yoke as fast as possible to get it quickly off the sea floor and to quickly obtain good clearance to the sea floor, such that potential impacts with the sea floor when the vessel moves downwards in the following waves are avoided. It is typically acceptable with a lower weather limit for re-connection compared to disconnection, which means that for re-connection the winch operation can follow a typical procedure.

Figure 7:
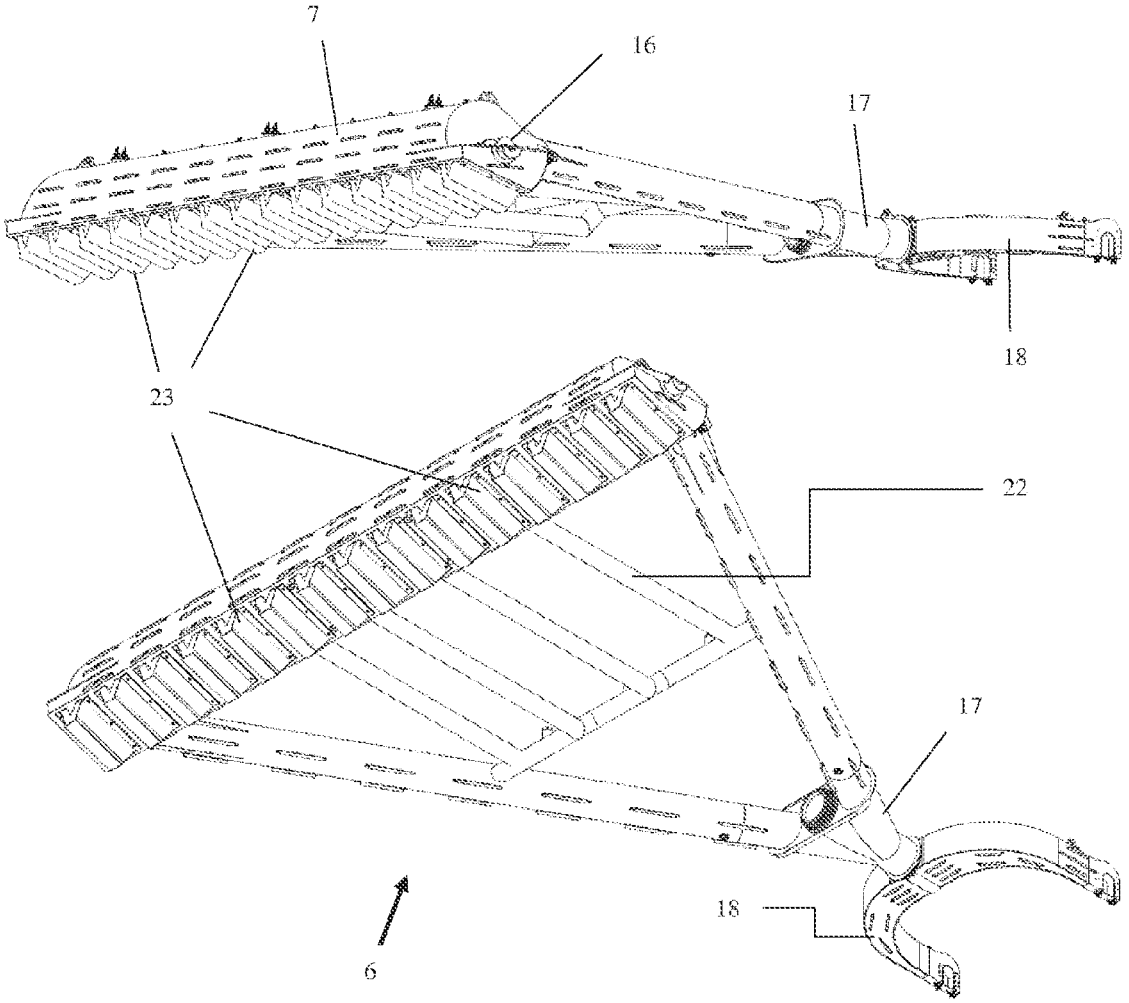
FIG. 7 shows two views of a mooring yoke equipped with means (in this case fenders) to soften the impact with sea floor when the yoke is lowered from the vessel.

Another inventive step that reduces the impact load is to attach means on the yoke 6 that absorb the energy at impact. These means can be passive means, such as rubber fenders 23 as shown in FIG. 7. Size, material and type of fender depend on the soil characteristics of the sea floor. If the sea floor can absorb a portion of the impact energy, then less energy needs to be absorbed by fenders to avoid damage to the yoke. In such a situation no specific fenders or only small fenders may be required.

Fenders on the yoke will not reduce the peak load in the tethers when the vessel is moving upwards after impact with the sea floor, i.e. peak load initiated by the instant lift of the yoke from the sea floor after impact. Adjustable winch speed as described above may reduce the peak load, but to avoid peak loads a third inventive step is included, in which the winch is switched from working with a hold-back capacity during lowering equal to the weight of the entire yoke assembly (including yoke, mooring tethers and jumper beam) to a hold-back capacity equal to the weight of the mooring tethers only after the yoke has landed on the sea floor. This implies that when the yoke 6 has landed on the sea floor and the vessel moves upwards the primary winch will pay-out freely for tether loads above the weight of the tether. In this way the yoke will stay on the sea floor after firm contact, i.e. it will not be lifted again, but the tethers will be kept off the sea floor until they are lowered in a controlled manner by the secondary winch. This feature can also be obtained by an embodiment where the pay-out speed of the winch line (32) is configured to be lower when the tension in the winch line is high and higher when the tension in the winch line is low. The secondary winch, which typically has much smaller pull capacity than the primary winch, may also be equipped with a motion-compensated system, if required. With a chain-jack as the primary winch the release of chain at the time of yoke impact with sea floor will be by measuring the tether tension and then by opening the chain-lock in the chain-jack when the measured tension shows that the yoke is on the sea floor.

Figure 8:
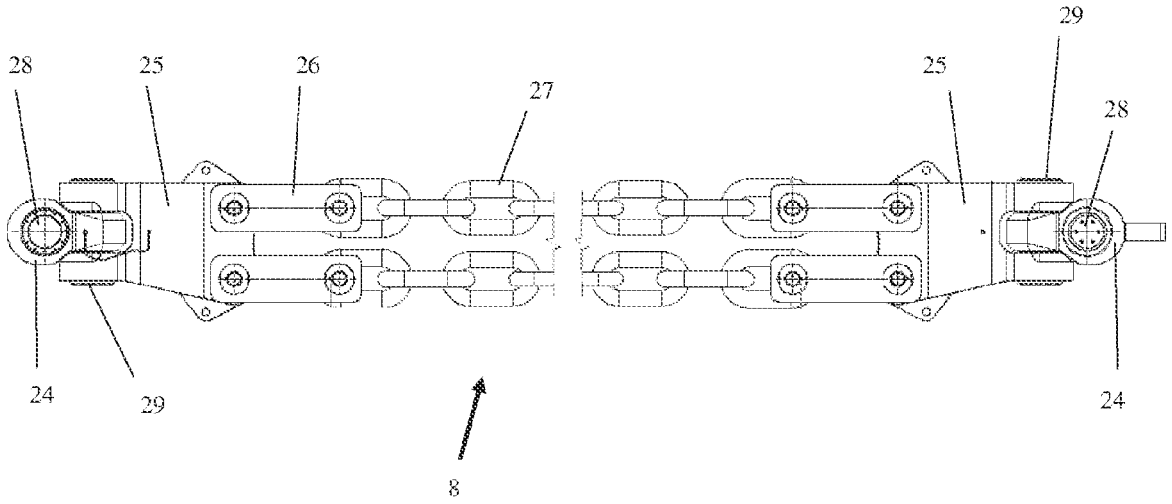
FIG. 8 shows a typical mooring tether arrangement.

FIG. 8 shows a typical mooring tether arrangement. Various alternatives exist, but common for all is that they all need a two degrees-of-rotational-freedom joint at each end and means to allow some twist. In the shown arrangement the two degrees-of-rotational-freedom is obtained by the first connecting link 24, the second connecting link 25, the main pin 28 and the second pin 29. The freedom to twist is obtained by the chain segments 27, in which a chain link connected to another chain link allows some relative rotation around the longitudinal axis of the chain segment. Number of chain segments 27 per mooring tether typically varies between 1 and 3.

Figure 9:
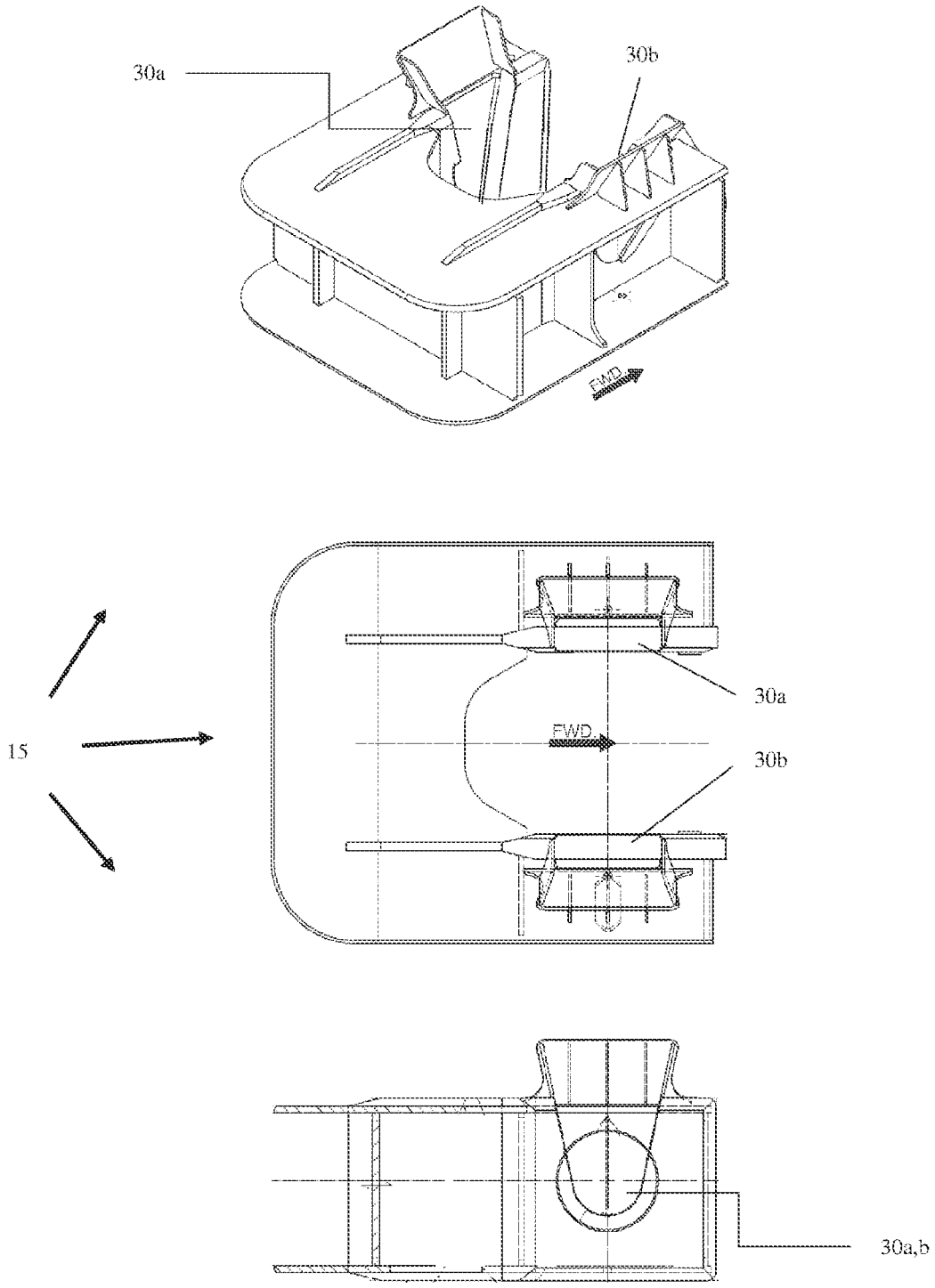
FIG. 9 shows a typical mooring cradle for the tether hang-off on the vessel.
Figure 10:
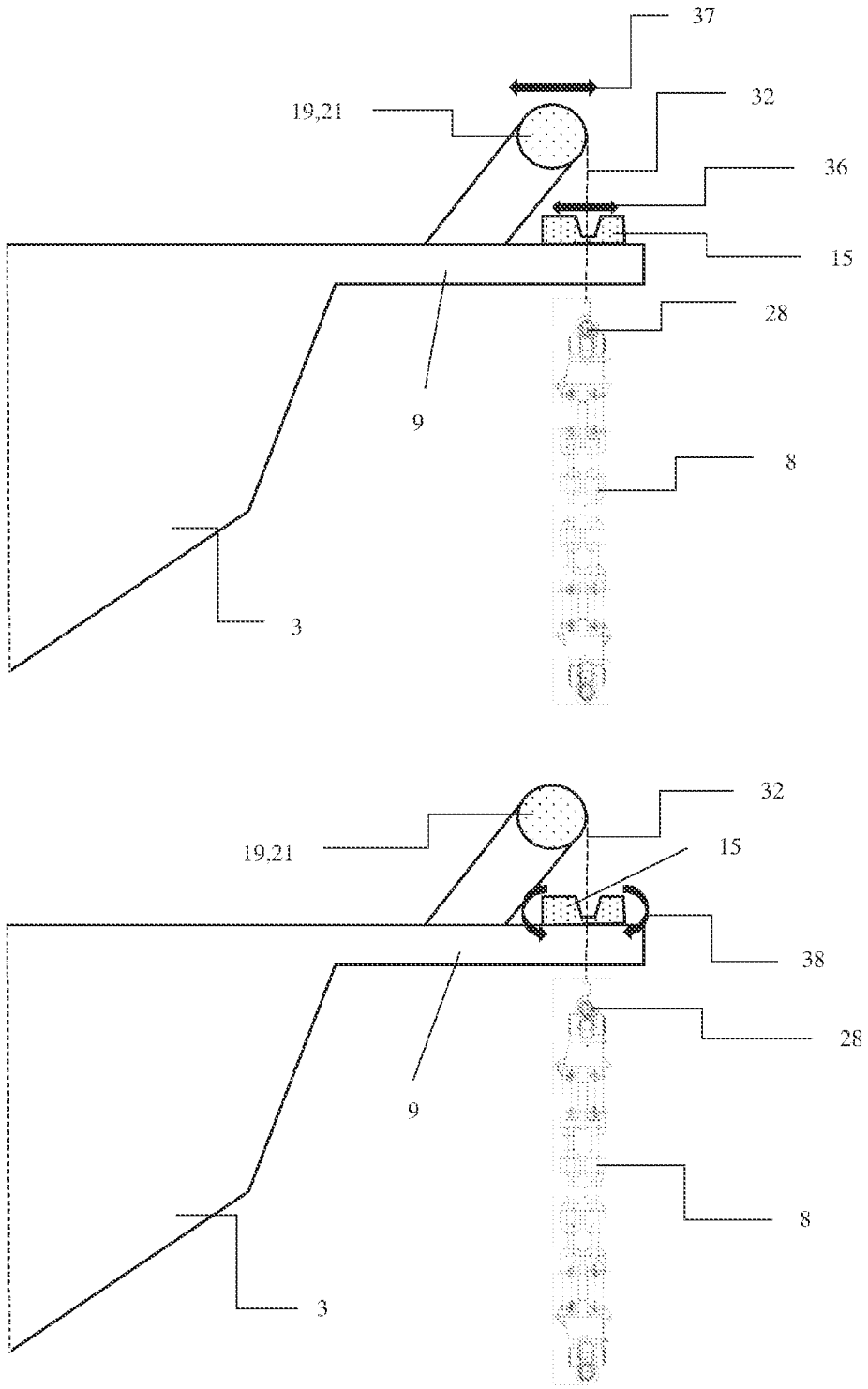
FIG. 10 shows alternative ways to mate mooring tether with mooring cradle.

FIG. 9 shows a typical arrangement for the mooring cradle 15. In this embodiment the main pin 28 is placed into the grooves 30*a,b* of the mooring cradle. The grooves are open in the top and closed at the bottom. This means that the pin will be placed in the grooves from the top and prevented from falling out. A securing device can be added to prevent the tether to work itself out through the open part, but due to the weight of the yoke and by a proper design of the grooves this is considered as an unlikely event. The pin 28 will have a circular interface towards the connecting link 24 such that it can provide a rotational freedom. However, the interface towards the mooring cradle does not need to be circular. If it is circular the locking for rotation in the cradle will be friction or other locking means, while if it is any other shape it will be mechanically locked from rotation by its own shape. To remove the mooring tether from the cradle and insert the mooring tether into the cradle the winch 19 will relieve the cradle from the tether load. The cradle can then be moved aside, such as illustrated in FIG. 10 by the direction 32. In another embodiment the cradle is kept in a fixed position while the winch or sheave arrangement is moved, as illustrated by direction 37. In a third embodiment the cradle is rotated such that the open and closed part of the grove 30 shift position, as illustrated by direction 38.

Figure 12:
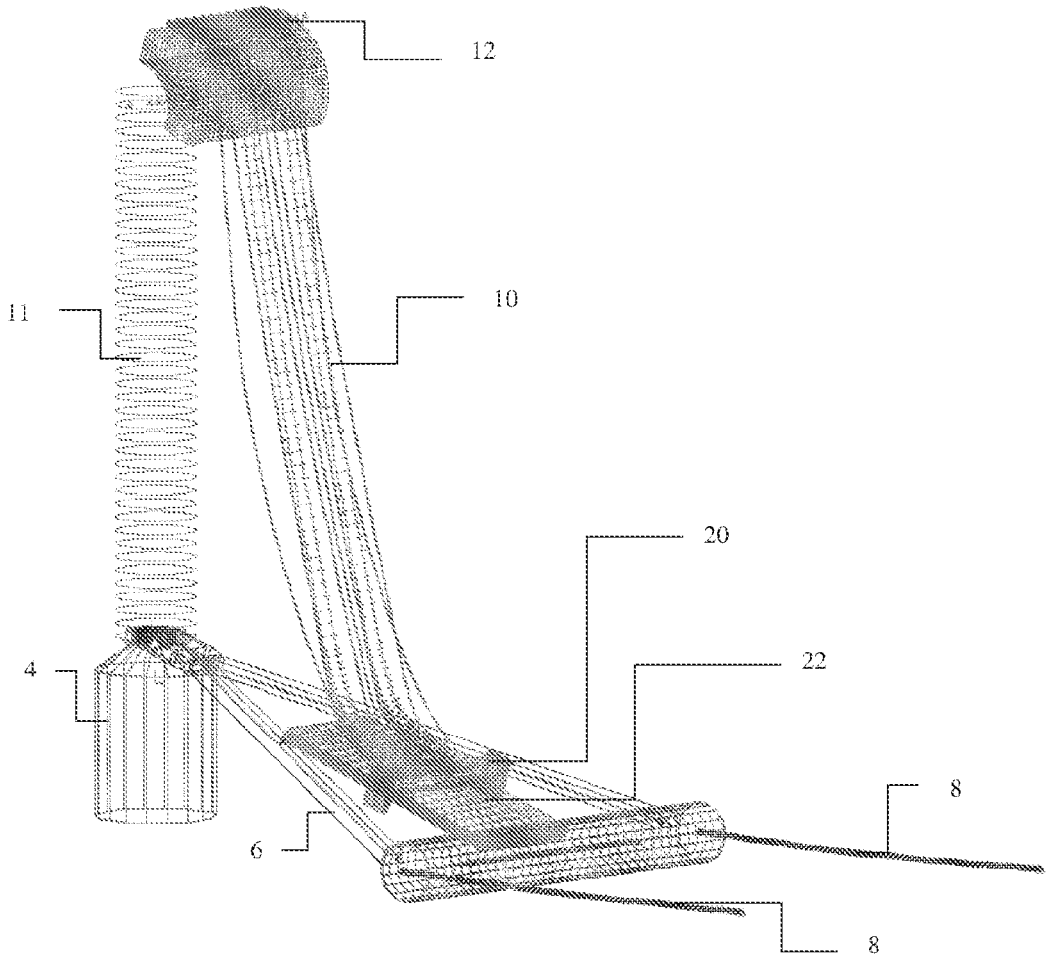
FIG. 12 shows the submerged yoke system with fluid swivel above sea level, when the system is fully disconnected from the vessel.

FIG. 12 shows the submerged yoke system with fluid swivel above sea level in disconnected mode. Even for very extreme weather conditions the yoke 6 will by its own weight be stable on the sea floor 1. Further, the weight of the jumper beam 20 will secure that it is not lifted off the interfacing parking structure 22 on the yoke, but only slide along the interfacing structure in the x-axis direction of the yoke. This means that the jumpers 10, which will be exposed to the waves, are well anchored at both the upper and lower end, implying high survivability in extreme weather conditions.

Figure 13:
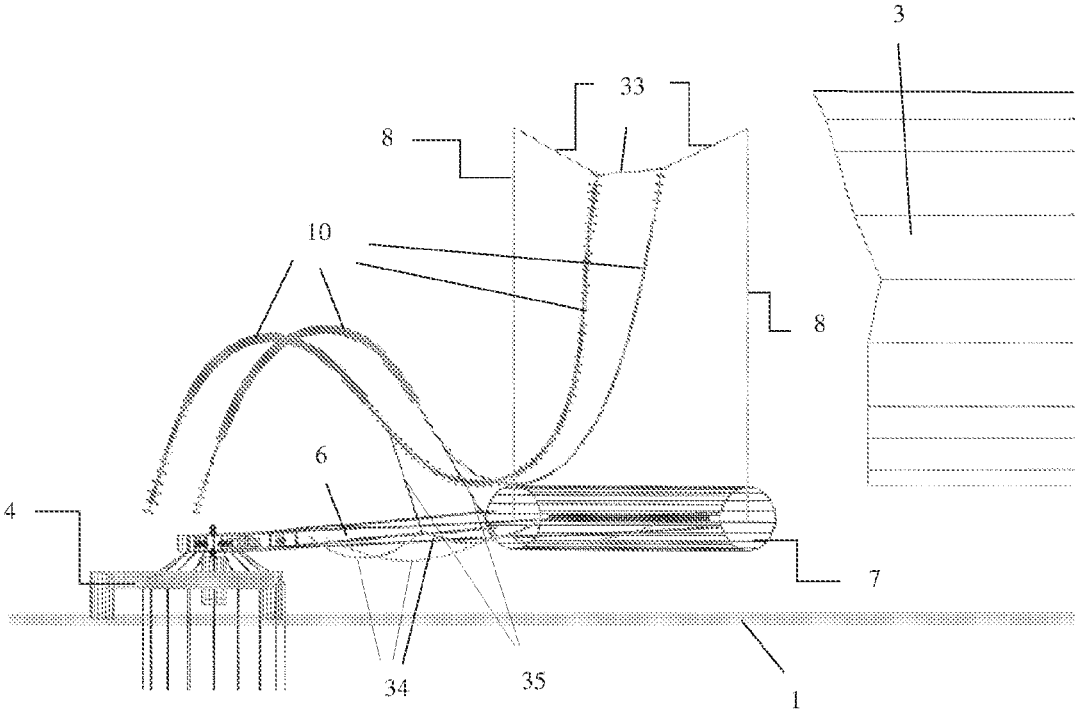
FIG. 13 shows a submerged yoke system with fluid swivel below sea level with multiple jumpers, where the jumper configuration is balanced by buoyancy elements and weight elements.
Figure 14:
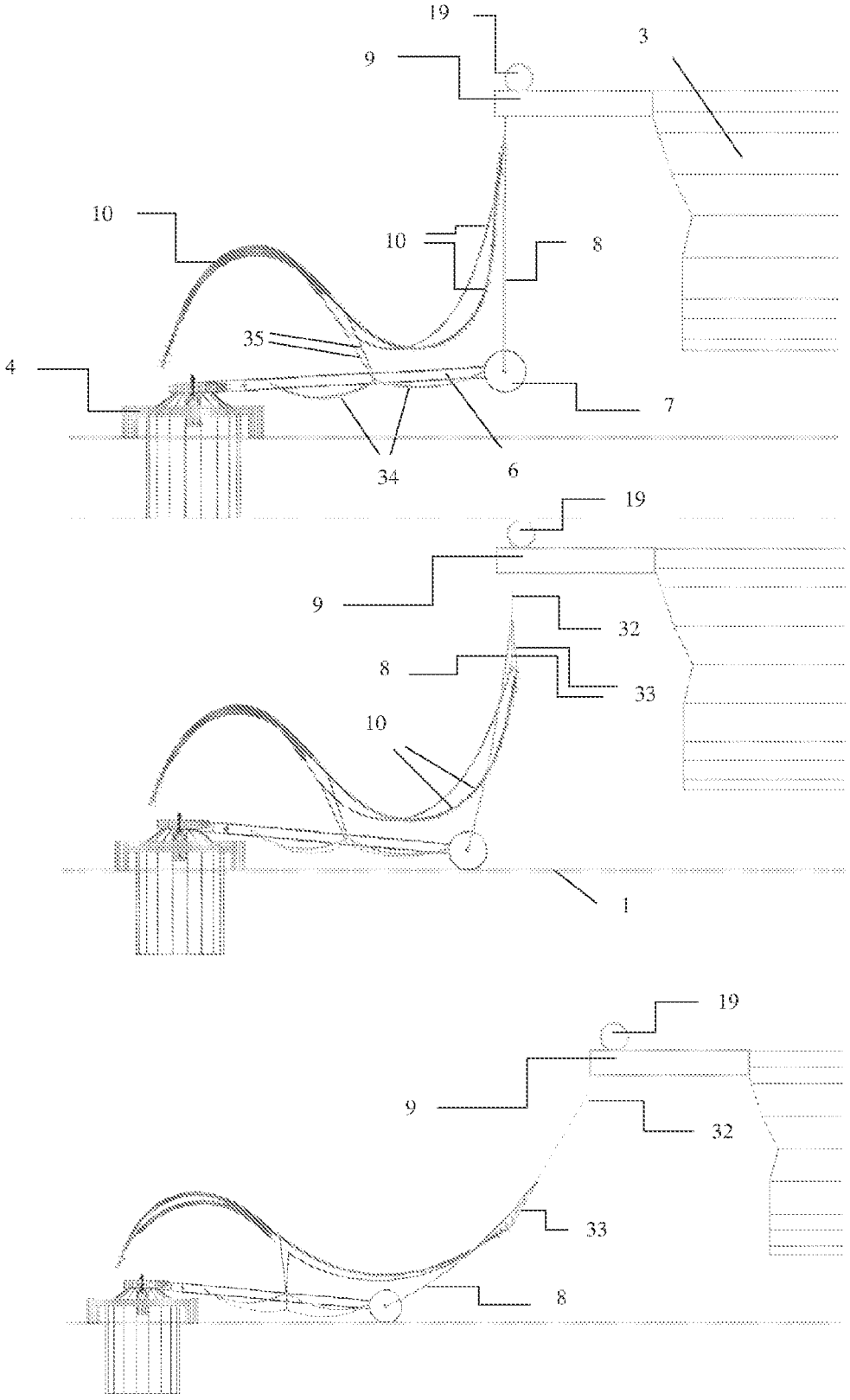
FIG. 14 shows a disconnect sequence for a submerged yoke system with fluid swivel below sea level.
Figure 15:
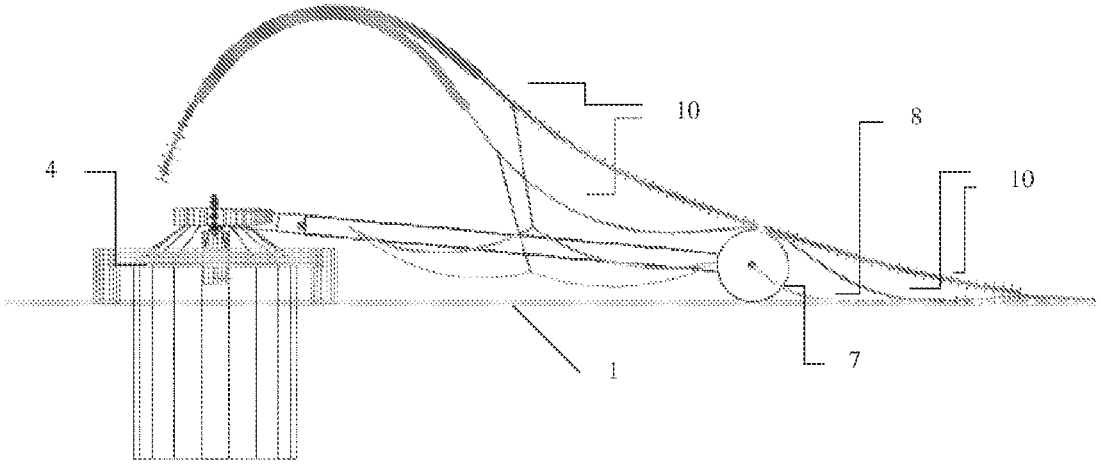
FIG. 15 shows the submerged yoke system with fluid swivel below sea level, when the system is fully disconnected from the vessel.

FIG. 13 shows a submerged yoke system with fluid swivel below sea surface. Several alternative configurations of the jumpers exist. One alternative is shown in FIG. 3. Another alternative is shown in FIG. 13, in which the jumpers are fitted with distributed buoyancy elements forming a wave-shaped configuration. To obtain a better control of the behavior of the jumpers in wave and for the envelope of vessel motions the jumpers may in one embodiment be connected to heavy lines 34 via connecting lines 35. For the embodiment with submerged fluid swivel the jumper beam 20 is not suitable in the same way as for the system with fluid swivel above sea surface, because it is not possible to land and park it on the yoke 6. With many jumpers a jumper beam in one way or the other may still be a good solution, but with only a limited number of jumpers (only two in FIG. 13) an alternative arrangement with suspension lines 33 may be selected. In this arrangement the connectors 39 and 41 are combined units. When these connectors have been released as part of a disconnection operation the jumpers are connected via suspension lines 33 to the mooring tethers 8, such that the jumpers 10 do not fall on the sea floor when the connectors are released. The mooring tethers are then disconnected in the same way as described above for the system with fluid swivel above sea surface, with the only difference that the jumpers are lowered together with the mooring tethers and placed on the seabed next to the mooring tethers. An illustration of the lay-down process is given in FIG. 14, while FIG. 15 shows the disconnected system. In another embodiment the suspension lines 33 are not used, but separate winches for each jumper is used, which are operated simultaneously to the winches for the mooring tethers during the lay-down process.

Re-connection will mainly follow the same steps, but in opposite order and with a simpler and more standard winch operation since the weather conditions during re-connection is typically less severe than for disconnection.

REFERENCE NUMERALS

1 Sea floor
2 Sea surface
3 Floating vessel
4 Structure attached to sea floor
5 Means of attaching structure on sea floor to sea floor, such as pile
6 Mooring yoke
7 Heavy part of mooring yoke
8 Mooring tether
9 Mooring hang-off arm on vessel
10 Flexible fluid line, also referred to as jumper
11 Tower structure
12 Topside including fluid swivel
13 Access bridge
13*a* Access bridge when connected to topside
13*b* Access bridge when parked on vessel
14 Mooring turret for rotation about z-axis
15 Mooring cradle on vessel
16 Attachment means between tethers and mooring yoke

17 Means for rotation about x-axis
18 Means for connection to mooring turret and means for rotation about y-axis
19 Primary winch
20 Jumper beam
20*a* Jumper beam when connected to vessel
20*b* Jumper beam when resting on yoke
21 Secondary winch
22 Means on mooring yoke for parking jumper beam on yoke, when jumper beam is disconnected from vessel
23 Means for reducing impact loads when mooring yoke is landing on sea floor, such as fender
24 First connecting link
25 Second connecting link
26 Means for connecting chain to second connecting link
27 Mooring chain
28 Main connecting pin between mooring tether and mooring yoke, or between mooring tether and mooring cradle.
29 Means for rotation (pin) with rotational axis perpendicular to axis of rotation for main connecting pin.
30 Groove in mooring cradle for main connecting pin.
31 Winch line for jumper beam
32 Winch line for mooring tether
33 Suspension line for attaching jumper to mooring tether or neighbor jumper during disconnection/connection.
34 Flexible weight element for jumper
35 Line for connecting jumper to flexible weight element.
36 Potential mooring cradle movement
37 Potential winch or winch sheave movement
38 Potential mooring cradle rotation
39 Structural connectors for jumper beam
40 Guide and locking mean for controlling and restricting motion in y-direction of jumper beam when parked on yoke
41 Connector for fluid, power or utility lines/jumpers

The invention claimed is:

1. A system for quick release of mooring, loading and unloading lines between a station at sea and a vessel during heave motions, wherein the station is a loading and unloading station comprising a swivel and wherein the system comprises:

a rigid yoke connected to a lower part of the loading and unloading station and being rotable around:

a vertical z-axis going through the loading and unloading station, a horizontal x-axis in the length direction of the rigid yoke and a horizontal y-axis orthogonal to the horizontal x-axis, and wherein the rigid yoke has a heavy section at an outer end of the rigid yoke;

at least two mooring tethers, for connection between the outer end of the rigid yoke and the vessel;

at least one loading or unloading line connected to a swivel on the holding and unloading station being rotable around the same vertical z-axis as the rigid yoke;

mooring cradles each mounted on a mooring arm on the vessel for connecting the at least two mooring tethers to a bow or a stern of the vessel;

a winch line connected to an upper end of each of the at least two mooring tethers;

connectors for connecting the mooring, loading, and unloading lines to the vessel; and a winch arrangement for handling the at least two mooring tethers and the winch line;

the winch arrangement being arranged for a pay-out speed of the at least two mooring tethers to be lower when the vessel, at the position of the mooring cradles, is moving downwards and for the pay-out speed to be higher when moving upwards, based on measuring tension on the at least two mooring tethers, the winch arrangement being switchable from a hold-back capacity of an entire yoke assembly, including the rigid yoke and the at least two mooring tethers, to a hold-back capacity of the at least two mooring tethers only, when the rigid yoke has landed on the sea floor and fenders to absorb impact energy at the bottom of the rigid yoke.

2. The system according to claim 1 wherein the winch arrangement comprises a primary winch pulling the weight of the entire yoke assembly and a secondary winch pulling the weight of the at least two mooring tethers, wherein the primary winch is released when the rigid yoke lands on the sea floor, thus switching from a hold-back capacity of the entire yoke assembly to a hold-back capacity of the at least two mooring tethers only when the rigid yoke lands on the sea floor.

3. The system according to claim 2 wherein the winch line comprises a pull chain connected in one end to a connecting link of the at least two mooring tethers and extending past the primary winch and connected in the other end to a rope which is further connected to the secondary winch.

4. The system according to claim 1, wherein the pay-out speed of the winch arrangement is adjusted by disc brakes, drum brakes, electrical or hydraulic motors.

5. The system according to claim 1, wherein each of the at least two mooring tethers comprises at least one chain segment.

6. The system according to claim 1 wherein the swivel is above sea level.

7. The system according to claim 6, wherein the mooring, loading and unloading lines are connected to a common jumper beam for connection to the vessel via connectors, and where the jumper beam with the mooring, loading and unloading lines is lowered and parked on the rigid yoke when disconnected from the vessel.

8. The system according to claim 7, wherein the jumper beam is fully locked to the rigid yoke when parked on the rigid yoke.

9. The system according to claim 7, wherein the jumper beam can slide along the horizontal axis (x-axis) of they rigid yoke.

10. The system according to claim 1 wherein the swivel is below sea level.

11. The system according to claim 1, wherein the mooring loading and unloading lines are attached to each other with suspension lines at the end towards the vessel.

12. The system according to claim 1, wherein the mooring loading and unloading lines are further attached to the at least two mooring tethers at the end towards the vessel.

13. The system according to claim 1, wherein the mooring cradles are moveable to allow the at least two mooring tethers to be lowered or pulled up.

14. A method for quick release of the mooring system of claim 1 comprising a) disconnecting the mooring loading and unloading lines, and connecting them directly or indirectly to a winch;

b) lowering the connectors to be parked on a parking structure on the rigid yoke if the swivel is above sea level;

c) lowering the rigid yoke by the winch arrangement after the line connectors are parked on the parking structure if the swivel is above sea level, and lowering the connectors simultaneously with the rigid yoke if the swivel is below sea level;

d) stopping the winch arrangement from pulling on the rigid yoke when the rigid yoke has landed on the sea floor by switching from a hold-back capacity of the entire yoke assembly to a hold-back capacity of the at least two mooring tethers only, and e) further lowering the at least two mooring tethers into a parked position in a direction mainly parallel with a centerline of the rigid yoke on the sea floor by moving the vessel astern, and simultaneously lowering the line connectors with the at least two tethers if the swivel is close to the sea floor.

* * * * *